United States Patent [19]

Fratty

[11] 4,276,583

[45] Jun. 30, 1981

[54] NOVEL RECTANGULAR HEADLIGHT FOR AUTOMOBILE

[75] Inventor: Hector Fratty, Boulogne S. Seine, France

[73] Assignee: Cibie Projecteurs, Bobigny, France

[21] Appl. No.: 904,960

[22] Filed: May 11, 1978

[30] Foreign Application Priority Data

May 23, 1977 [FR] France ..... 77 15698

[51] Int. Cl.[3] ..... F21M 3/14

[52] U.S. Cl. ..... 362/214; 362/346

[58] Field of Search ..... 362/211, 214, 346, 212, 362/213, 215

[56] References Cited

U.S. PATENT DOCUMENTS

| | | | |
|---|---|---|---|
| 3,898,451 | 8/1975 | Murphy et al. | 362/211 |
| 4,029,985 | 6/1977 | Rachel | 362/211 |

OTHER PUBLICATIONS 142 mm ×200 mm Sealed Beam Headlamp Unit SAE J1132, SAE Recommended Practice–Report of Lighting Committee Approved Jan. 1976.

*Primary Examiner*—Harold J. Tudor

*Attorney, Agent, or Firm*—Cullen, Sloman, Cantor, Grauer, Scott, & Rutherford

[57] ABSTRACT

The present invention relates to a headlight for automobile, with rectangular front opening, of the type comprising a reflector in the axis of which are disposed a light source for dipped-beam illumination cooperating with cut-off means, and a light source for far-beam illumination, a horizontal upper side and a horizontal lower side intersecting the reflector to delimit the rectangular opening of the headlight, wherein the upper side is substantially closer to the optical axis than the lower side, with the result that, for a total, unchanged height of the headlight, the zone of the mirror furnishing the dipped-beam illumination is reduced, this allowing an optimum compromise for far-beam and dipped-beam illumination.

1 Claim, 5 Drawing Figures

NOVEL RECTANGULAR HEADLIGHT FOR AUTOMOBILE

The present invention relates to automobile headlights adapted to emit a dipped-beam and far-beam through a substantially rectangular front opening.

BACKGROUND OF THE INVENTION

Such headlights are widely used: they generally comprise a parabolic reflector (of revolution) in the axis of which are disposed a light source for dipped-beam illumination and a light source for far-beam illumination, a horizontal upper side and a horizontal lower side not having any optical role, completing the casing of the headlight, thus giving it a substantially rectangular opening.

In all heretofore proposed embodiments, the two sides are symmetrically disposed with respect to the optical axis, the headlight with rectangular opening thus being treated by construction as a round headlight also truncated at the top and bottom.

In other words, if the total height of the headlight is considered to be 2h, its upper side and its lower side are separated from the optical axis by a distance h.

THE DRAWING

FIG. 1 illustrates in vertical axial section the conventional arrangement of such a headlight comprising a reflector R, two sides $J_1$ and $J_2$, an optical axis O-O along which is mounted a lamp having a far-beam filament $F_R$ and a dipped-beam filament $F_C$. It is to be noted that the two sides $J_1$ and $J_2$ are equidistant from the axis O-O by the half-height h.

If, for such headlights, the formation of the two far- and dipped-beams is considered, it is noted that the dipped-beam is emitted by the light rays issuing from $F_C$, and which strike the reflector R without having been stopped by the cut-off means serving to delimit the dipped beam (generally these cut-off means are constituted by a screen 10 surrounding the dipped-beam filament $F_C$). This results in the dipped beam corresponding to the light reflected by a zone C occupying the whole of the upper part and a small fraction of the lower part of the reflector.

Figure 1:
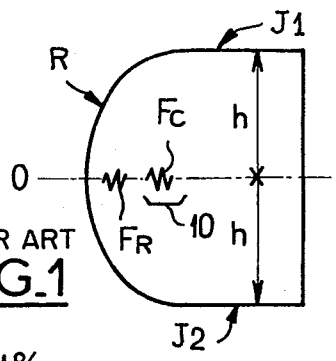
PRIOR ART FIG 1
FIG. 1 is a schematic vertical section of a classical headlamp illustrative of the prior art.
Figure 2:
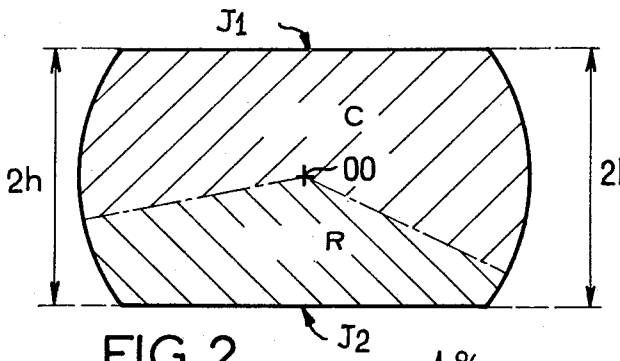
FIG 2 PRIOR ART
FIG. 2 is a schematic front view of the reflective mirror of said headlamp.

FIG. 2 which shows the reflector in front view illustrates this arrangement.

Below the zone C of the reflector, the zone R has an optical role only for the far-beam, for which the two zones, i.e. the whole reflector, are used.

In this arrangement, the height 2h of the rectangular headlight essentially determines the performances obtained both for the dipped-beam and for the far-beam.

Figure 3:
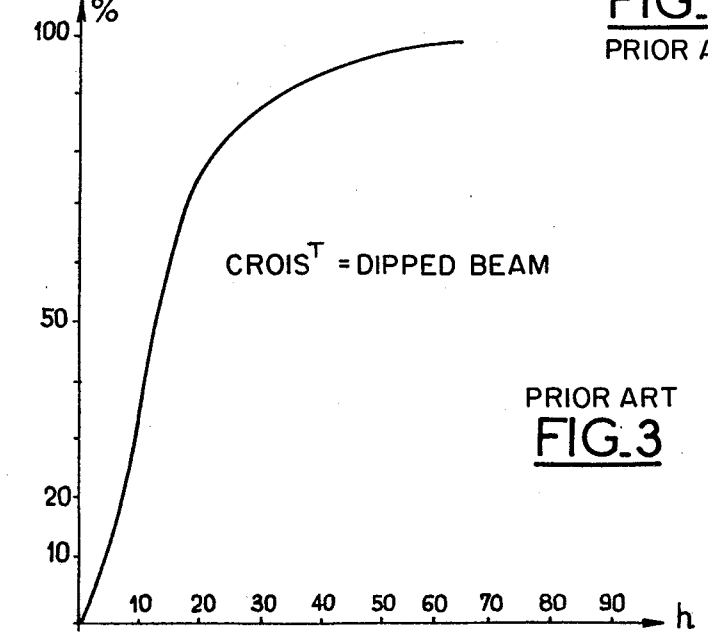
PRIOR ART FIG 3
FIGS. 3 and 4 are diagrams relative to said prior art headlamp respectively illustrating dipped-beam efficiency relative to the half height of the top and bottom of the reflector with respect to the central optical axis and the far beam efficiency for same in accordance with the prior art.

In this respect:

FIG. 3 shows, as a function of the half-height h of the mirror expressed in millimeters, the performances (useful flux) of a rectangular reflector in dipped-beam expressed as a percentage of the performances of a round (not truncated) reflector of diameter 2h and of the same focal length.

Figure 4:
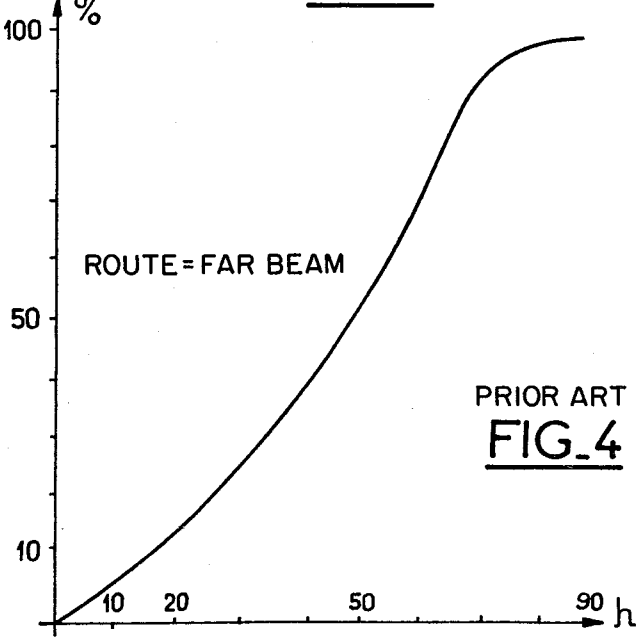
PRIOR ART FIG 4

FIG. 4 shows a similar diagram for the far-beam.

For relatively short half-heights of a rectangular headlight, a satisfactory dipped-beam is obtained (i.e. close to that of a round headlight): for a half-height of only 30 mm, the beam already has 90% of the performances of the homologous beam of a round headlight (cf. FIG. 3).

On the other hand, (cf. FIG. 4), the far-beam of a rectangular headlight remains unsatisfactory for short heights, and it varies notably with the height used: for a half-height of 70 mm, the performances of the far-beam are twice as great as those which are obtained for a half-height of 40 mm.

These results clearly follow, moreover, from the shapes and areas of the zones C and R and their variations as a function of h.

Finally, it is seen that, for a rectangular headlight, the dipped-beam is satisfied with a short headlight height whilst the far-beam requires a substantially greater height.

On the basis of these findings, the present invention proposes a novel structure of headlight of the type with rectangular front opening.

The gist of the invention is to improve the optical performances by reducing the height of the zone C to the benefit of that of zone R.

To this end, the invention proposes a headlight which is non-symmetrically truncated with respect to a round headlight of the same parabolic surface. According to the novel structure of the invention, the upper side $J_1$ is separated from the optical axis O-O by a distance $h_1$, and the lower side $J_2$ by a distance $h_2$, $h_1$ being much shorter than $h_2$.

These distances preferably satisfy the inequation:

$$\tfrac{1}{4}h_2 < h_1 < \tfrac{3}{4}h_2$$

Figure 5:
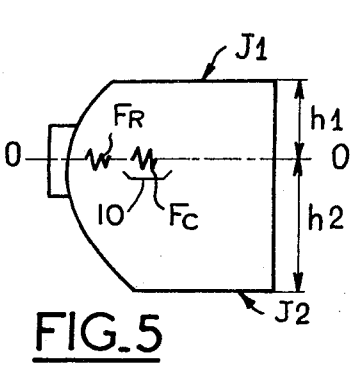
FIG. 5 is a schematic vertical section of the present headlamp corresponding to FIG. 1 with modified optical axis.

Such a structure is shown in FIG. 5.

The above theory and experience confirm that such a construction renders a rectangular headlight of the above-mentioned type optimum from the point of view of optical performances.

It is essential to note that such a solution, despite its simplicity, represents considerable progress, which had to be made, although rectangular headlights have been known for several years.

A numerical example will illustrate the interest of the invention.

It is assumed that the admissible height of a headlight is 100 mm.

If the reflector is symmetrical, the dipped-beam performances are 95% and far-beam performances 50% of the round reflector (cf. FIGS. 3 and 4).

If the mirror is dissymetrical, which $h_1=30$ and $h_2=70$, the performances will be, in dipped-beam, 90% and, in far-beam, 90%, or a loss (with respect to the symmetrical version) of 5% for dipped-beam for a gain of 80% for far-beam.

Of course, the invention is not limited to the single embodiment described and illustrated, but extends to any variant in accordance with its spirit, particularly for reflectors of any geometrical shape.

What we claim is:

1. A headlight for automobiles, with a substantially rectangular front opening, of the type comprising a parabolic reflector having an optical horizontal axis along which are disposed a light filament for dipped-beam illumination cooperating with cut-off means, and a light filament for far-beam illumination positioned rearwardly of said light filament for dipped-beam illumination, a horizontal upper side and a horizontal lower side intersecting the reflector to delimit the substantially rectangular opening of the headlight, wherein the upper side is substantially closer to said axis than the lower side, with the result that, for a total, unchanged height of the headlight, the zone of the reflector furnishing the dipped-beam illumination is reduced, and the zone of the reflector furnishing the far-beam illumination is increased, and wherein said upper side is distant from said optical axis by the distance $h_1$ and said lower side by a distance $h_2$, characterized by the inequation:

$$\tfrac{1}{4}h_2 < h_1 < \tfrac{3}{4}h_2;$$

this allowing an optimum compromise for far-beam and dipped-beam illumination.

* * * * *